US010506852B2

(12) United States Patent
Serfass et al.

(10) Patent No.: US 10,506,852 B2
(45) Date of Patent: Dec. 17, 2019

(54) MULTI-FUNCTIONAL BRACELET

(71) Applicant: Go Girl Designs, LLC, Knoxville, TN (US)

(72) Inventors: Lindsay Michelle Serfass, Knoxville, TN (US); Candice Leigh Cabe, Knoxville, TN (US)

(73) Assignee: Go Girl Designs, LLC, Knoxville, TN (US)

( * ) Notice: Subject to any disclaimer, the term of this patent is extended or adjusted under 35 U.S.C. 154(b) by 562 days.

(21) Appl. No.: 15/185,617

(22) Filed: Jun. 17, 2016

(65) Prior Publication Data

US 2016/0295974 A1 Oct. 13, 2016

Related U.S. Application Data

(63) Continuation-in-part of application No. 14/261,765, filed on Apr. 25, 2014, now abandoned.

(60) Provisional application No. 61/816,760, filed on Apr. 28, 2013.

(51) Int. Cl.
*A44C 5/00* (2006.01)
*A44C 15/00* (2006.01)

(52) U.S. Cl.
CPC ..... *A44C 5/0007* (2013.01); *A44C 5/003* (2013.01); *A44C 5/0084* (2013.01); *A44C 15/003* (2013.01)

(58) Field of Classification Search
CPC ..... A44C 5/0007; A44C 5/003; A44C 5/0084; A44C 15/003
See application file for complete search history.

(56) References Cited

U.S. PATENT DOCUMENTS

| | | | | |
|---|---|---|---|---|
| 6,276,369 | B1 | 8/2001 | Rogers | |
| 7,963,289 | B1 | 6/2011 | King | |
| 2005/0056298 | A1 | 3/2005 | McRoberts | |
| 2006/0048542 | A1* | 3/2006 | Barry | A44C 9/00 63/15.7 |
| 2008/0072922 | A1 | 3/2008 | Shidler | |
| 2013/0133365 | A1 | 5/2013 | Zannella | |
| 2015/0082830 | A1 | 3/2015 | Ingimundarson | |

* cited by examiner

*Primary Examiner* — Abigail E Troy
(74) *Attorney, Agent, or Firm* — Pitts & Lake, P.C.

(57) ABSTRACT

A multi-function bracelet that includes a cylindrical base member and at least a pair of elastic jewelry members carried by the cylindrical base member The multi-function bracelet further includes at least one elastic ring member adapted to be stretched over the stretched over and received between the elastic jewelry members. When removed from the bracelet the elastic ring member can be worn in the hair as an elastic hair band. Thus, the multi-function bracelet serves to function as an ornamental piece of jewelry and also as a receptacle and storage device for an elastic hair band when the elastic hair band is not being worn in the hair of the wearer of the multi-function bracelet.

10 Claims, 7 Drawing Sheets

MULTI-FUNCTIONAL BRACELET

CROSS-REFERENCE TO RELATED APPLICATIONS

This application claims the benefit of U.S. Non-Provisional patent application Ser. No. 14/261,765, filed on Apr. 25, 2014, which is a non-provisional application that claimed priority to Provisional Patent Application No. 61/816,760 filed on Apr. 28, 2013. The entire content of each of the foregoing applications is incorporated by reference herein.

STATEMENT REGARDING FEDERALLY SPONSORED RESEARCH OR DEVELOPMENT

Not Applicable

BACKGROUND OF THE INVENTION

1. Field of Invention

This invention pertains to a multi-functional piece of jewelry such as a bracelet. More specifically, the present invention pertains to a bracelet that is adapted to receive an elastic hair band when the elastic hair band is not being worn in the hair of the wearer of the bracelet.

2. Description of the Related Art

It is known that people who wear their hair in the style commonly known as a ponytail or a similar style often referred to as pigtails use an elastic hair band to hold their hair in this style. Elastic hair bands are also worn in the hair for practical reasons, i.e. to keep the hair away from the wearer's face. When not being worn in the user's hair, these elastic hair bands are frequently worn around the wearer's wrist, especially in situations where the wearer does not have pockets in which to store the elastic hair band. When worn around the wrist, the elastic hair band does not present a professional, or stylish, appearance, and can result in a residual groove, or indentation, in the skin of the wearer's wrist. Further, recent reports suggest that wearing a hair band around the wearer's wrist can lead to potentially serious skin infections.

Bracelets are often worn for reasons related to fashion. While there are bracelets that carry medical or emergency contact information that are worn for practical reasons, jewelry related bracelets are worn for aesthetic, style-driven, or fashion reasons. While there are many types and styles of bracelets, in different colors and constructed from different materials, a popular style of bracelet is known as a bangle bracelet. Bangle bracelets are commonly formed in a complete, substantially circular, shape and are rigid. It is known that the wearer simply slips the bangle bracelet over the fingers and hand in order to slide it onto the wrist. U.S. Patent Application US2013/0133365 published on May 30, 2013, and issued to Zannella as U.S. Pat. No. 9,265,309 on Feb. 23, 2016, describes a bracelet with a groove and cooperating indents for receiving an elastic hair band when the elastic hair band is not being worn. However, Zannella does not include and is not adapted to include annular, decorative jewelry strand members adapted and designed to provide an additional appeal of a jewelry aesthetic.

What is missing from the art is a decorative bangle bracelet, having a functional jewelry aesthetic that provides a place to decoratively wear an elastic hair band on a wearer's wrist in a manner that is aesthetically pleasing and that functions as a form of jewelry such as a bracelet. What is further missing is such a multi-functional bracelet that has removable decorative jewelry strand members. Accordingly, it is an object of the present invention to provide a bangle style, or similar style bracelet that is worn as an article of jewelry that is adapted to receive an elastic hair band, in an aesthetically pleasing manner, when such elastic hair band is not being worn in the hair of the wearer.

BRIEF SUMMARY OF THE INVENTION

According to one embodiment of the present invention, a multi-function bracelet is provided that includes a cylindrical base member having two cooperating outwardly extending edge members. Additionally, an outwardly extending annular wall member is disposed on the base member between the two edge members so as to provide for a pair of channels defined on the base member. At least a pair of elastic jewelry strand members are received by and carried by the base member. The multi-function bracelet further includes an elastic ring member adapted to be stretched over the elastic jewelry strand members and tautly received between the elastic jewelry strand members. When removed from the bracelet the elastic ring member can be worn in the hair as an elastic hair band. Thus, the multi-function bracelet serves to function as an ornamental piece of jewelry and also as a receptacle and storage device for an elastic hair band when the elastic hair band is not being worn in the hair of the wearer of the multi-function bracelet.

In order to facilitate removal of the elastic ring member from between the two elastic jewelry strand members, a graspable tab member is carried by the elastic ring member. While the tab member could be carried directly by the elastic ring member, in the preferred embodiment, it is attached to the elastic ring member by means of a jump ring. The tab member can be shaped or designed in any aesthetically pleasing manner so as to function as a charm.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
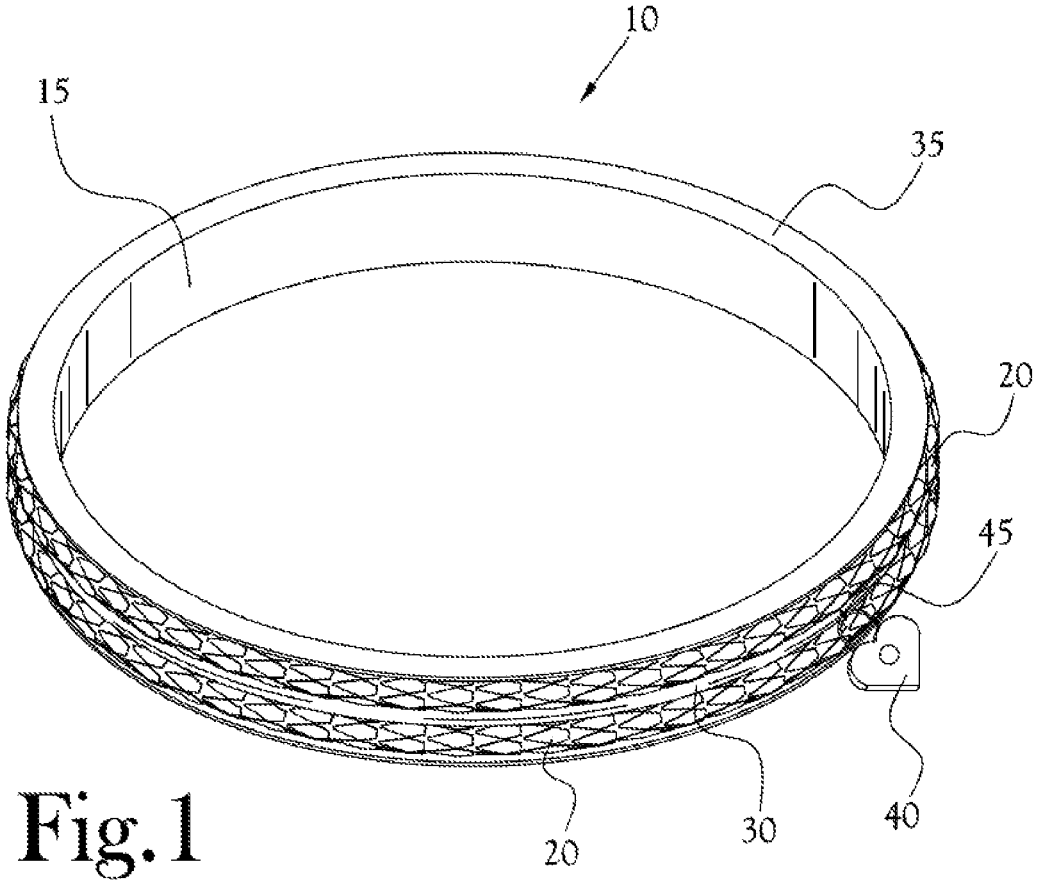
FIG. 1 is a perspective view of the multi-functional bracelet of the present invention.
Figure 2:
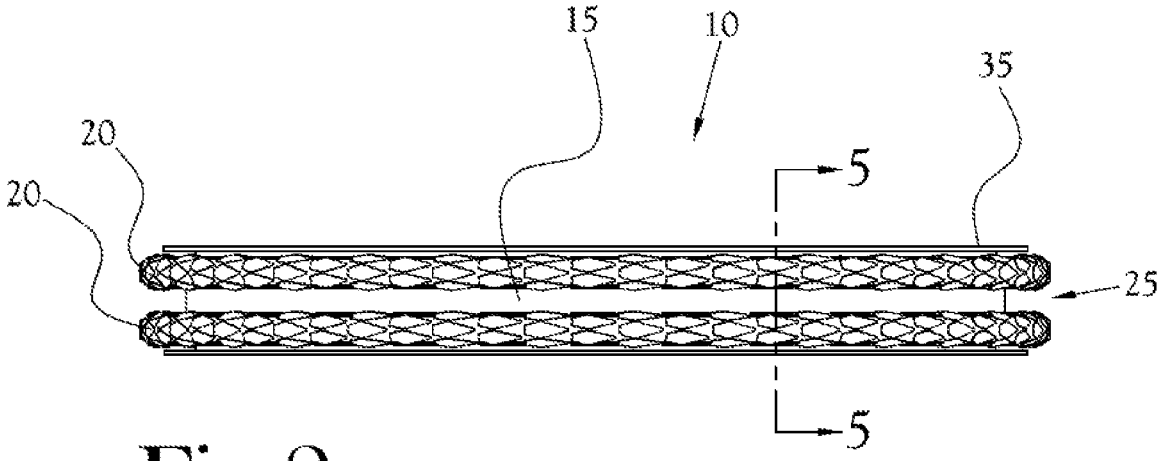
FIG. 2 is a side elevation view of the multi-functional bracelet as illustrated in FIG. 1 with the elastic ring member removed from the bracelet.

According to one embodiment of the present invention, illustrated in FIGS. 1, 2, 3A, and 3B, a multi-function bracelet 10 is provided that includes a cylindrical base member 15 having two outwardly extending edge members 35 and at least a pair of elastic jewelry strand members 20 carried by the cylindrical base member 15 between the two edge members 35. In an exemplary embodiment, the two edge members 35 project outwardly from and are in a substantially orthogonal relationship to the base member 15. The base member 15 is adapted to be received by and worn on the wrist of the user. In this regard, the base member 15 and the edge members 35 cooperate to define a bangle bracelet. The multi-function bracelet 10 further includes an elastic ring member 30 adapted to be stretched over the elastic jewelry strand members 20 and tautly received in the space 25 between the elastic jewelry strand members 20. When removed from the bracelet 10, the elastic ring member 30 can be worn in the hair of the wearer of the multi-functional bracelet 10 as an elastic hair band. Thus, the multi-function bracelet 10 serves to function as an ornamental piece of jewelry and also as a receptacle and storage device for an elastic hair band, defined by the elastic ring member 30, when the elastic hair band is not being worn in the hair of the wearer of the multi-function bracelet 10.

In one embodiment, the elastic jewelry strand members 20 include an inner elastic core 50 that allows the elastic jewelry strand member 20 to be stretched. The jewelry strand members 20 are elastic in an exemplary embodiment so as to allow easy placement on the base member 15, such that the jewelry strand members 20 are removably carried by the base member 15 so as to allow a plurality of jewelry strand members to be interchangeable. The elastic jewelry strand members 20, which can be rope-like, are rotatably received by the base member 15, and retained on the base member 15 by means of the edge members 35. Further, it will be recognized that the elastic jewelry strand members 20 could be smooth or could be ornamented with any type of engraving or could be defined by a plurality of links or beads.

Further, those skilled in the jewelry art will recognize that the base member 15 could be fashioned from any of the known jewelry materials including, but not limited to, plastics, ceramics, base metals or alloys, precious or semi-precious metals or alloys, or wood. Similarly, the elastic jewelry strand members 20 could be fashioned of different materials. Also, those skilled in the art will recognize that by being removable, the elastic jewelry strand members 20 are interchangeable thus giving the user great flexibility as to fashion and aesthetic choices.

Figure 3A:
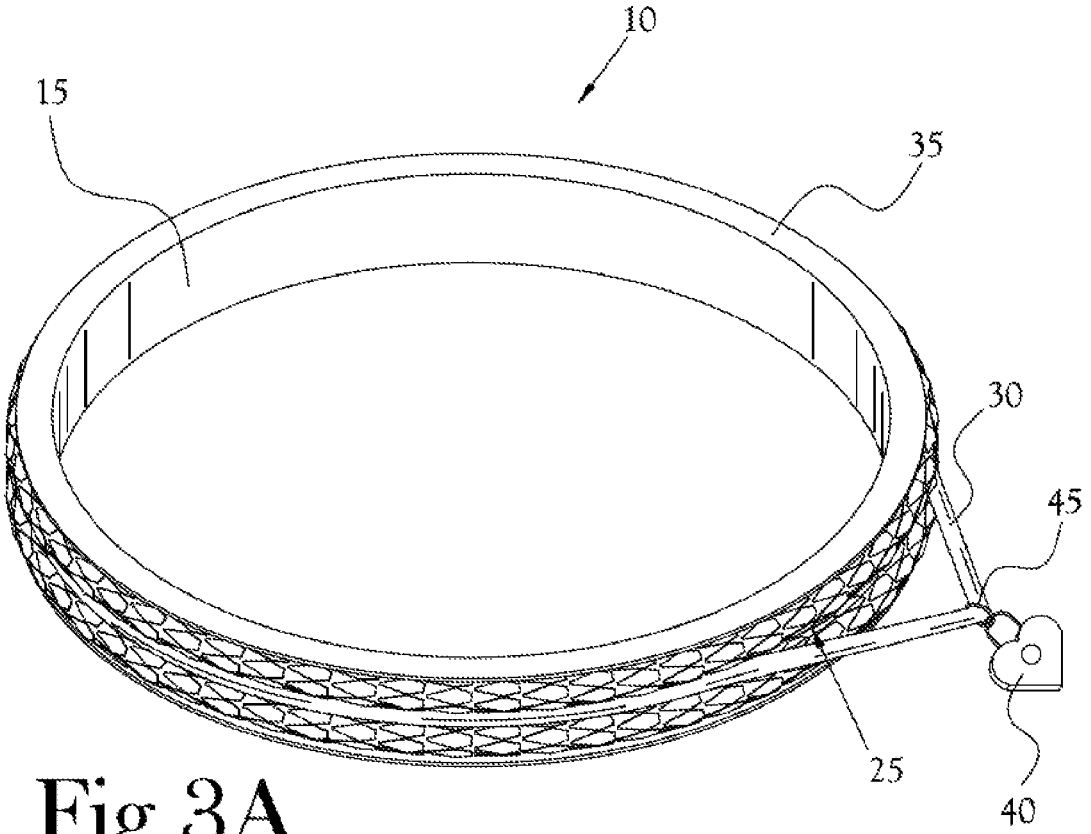
FIGS. 3A and 3B are a perspective view of the multi-functional bracelet as illustrated in FIG. 1, FIG. 3B being an enlarged section of 3A, showing the elastic ring member being stretched away from the base member prior to removal from the multi-functional bracelet.
Figure 3B:
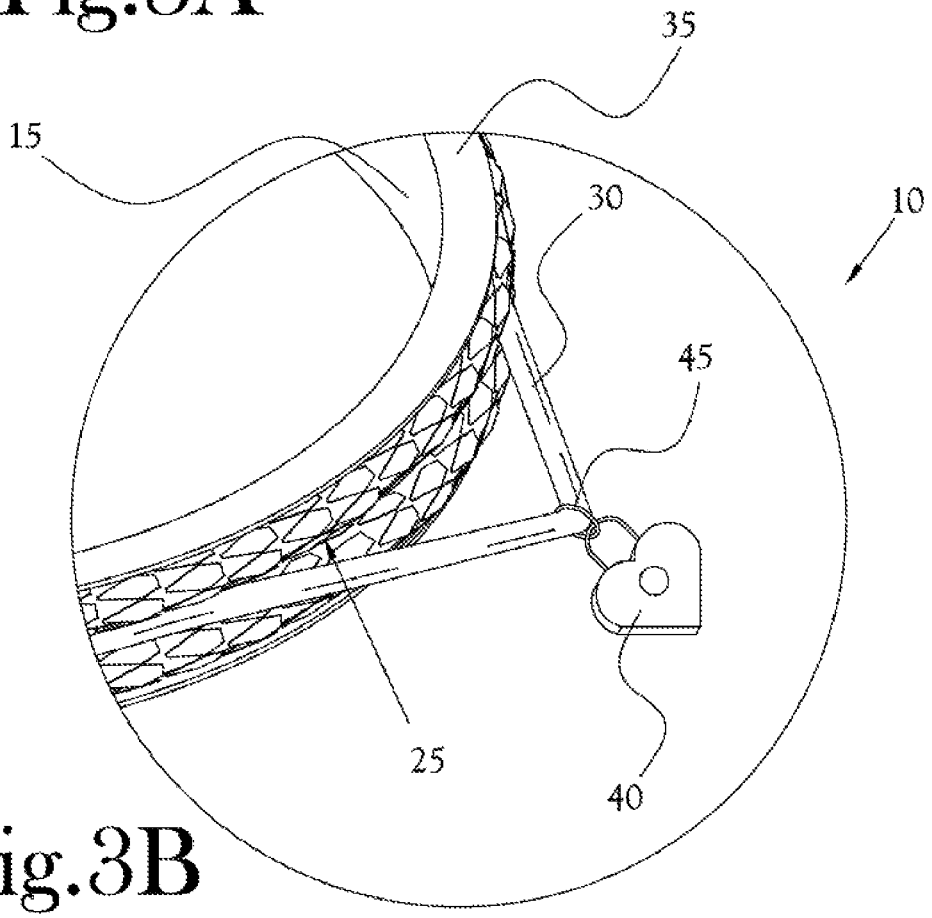

In order to facilitate removal of the elastic ring member 30 from between the two elastic jewelry strand members 20, a graspable tab member 40 is carried by the elastic ring member 30. While the tab member 40 could be carried directly by the elastic ring member 30, in the preferred embodiment, the tab member 40 is attached to the elastic ring member 30 by means of a jump ring 45. The graspable tab member 40 can be shaped or designed in any aesthetically pleasing manner so as to function as a charm. As illustrated in FIGS. 3A and 3B, the graspable tab member 40 allows the elastic ring member 30 to be stretched outwardly and removed from between the two elastic jewelry strand members 20.

Figure 4:
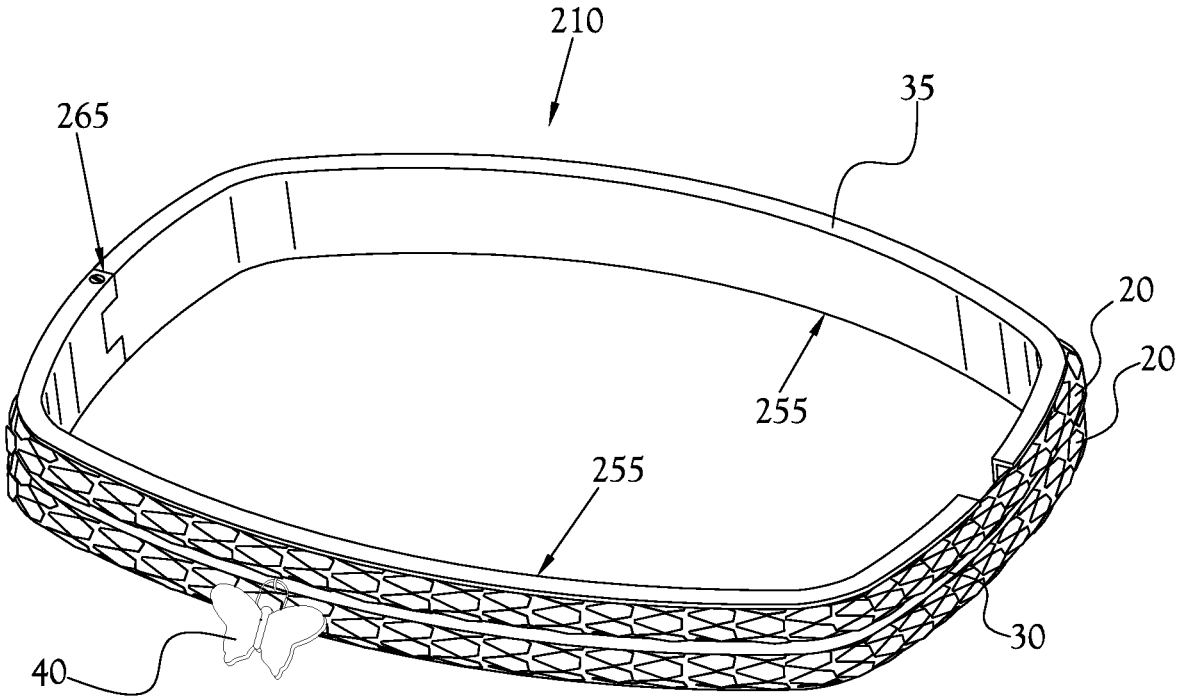
FIG. 4 is a perspective view of an alternate embodiment of the multi-functional bracelet of the present invention.
Figure 5A:
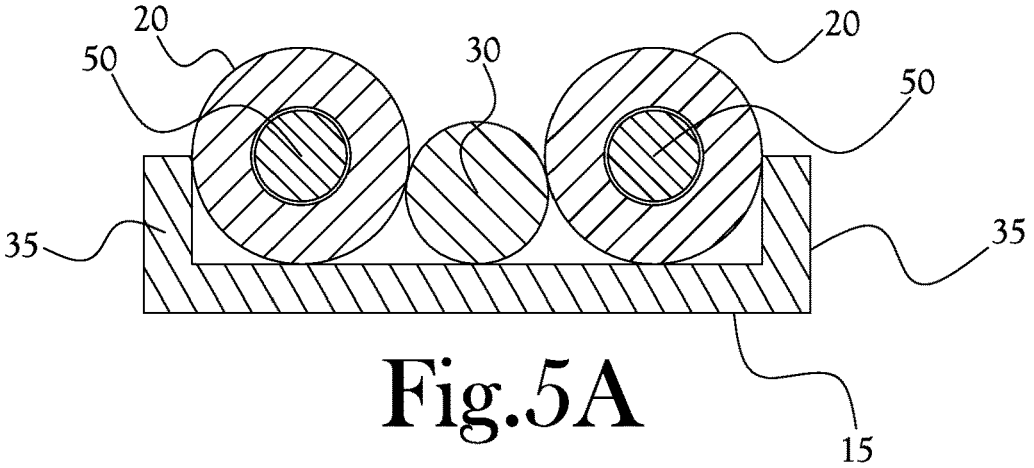
FIGS. 5A, 5B, and 5C are cross sectional views taken at cut-line 5 in FIG. 2.
Figure 5B:
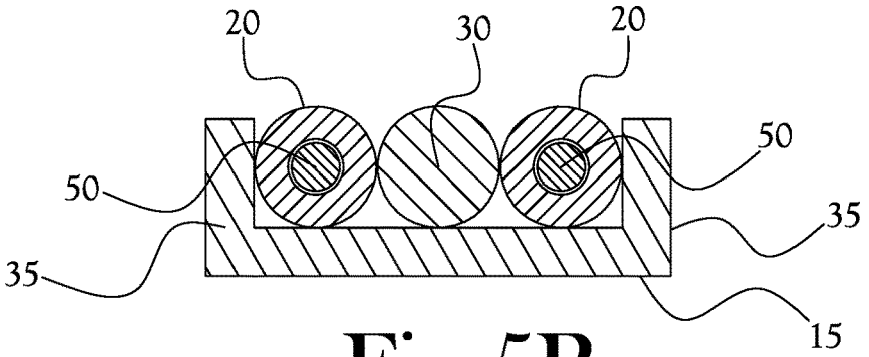
Figure 5C:
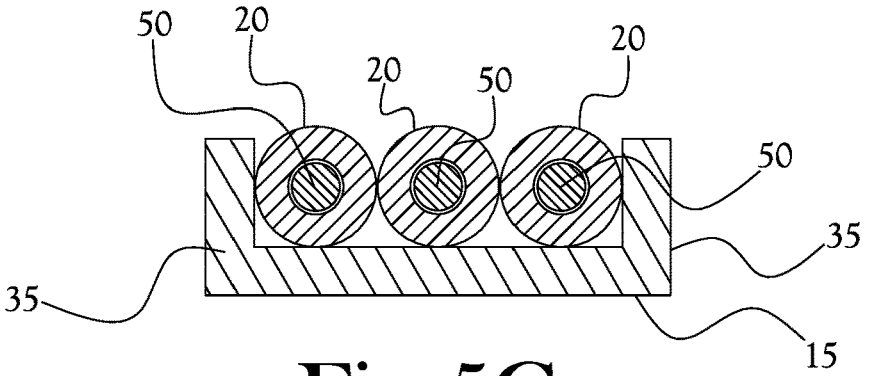
Figure 6:
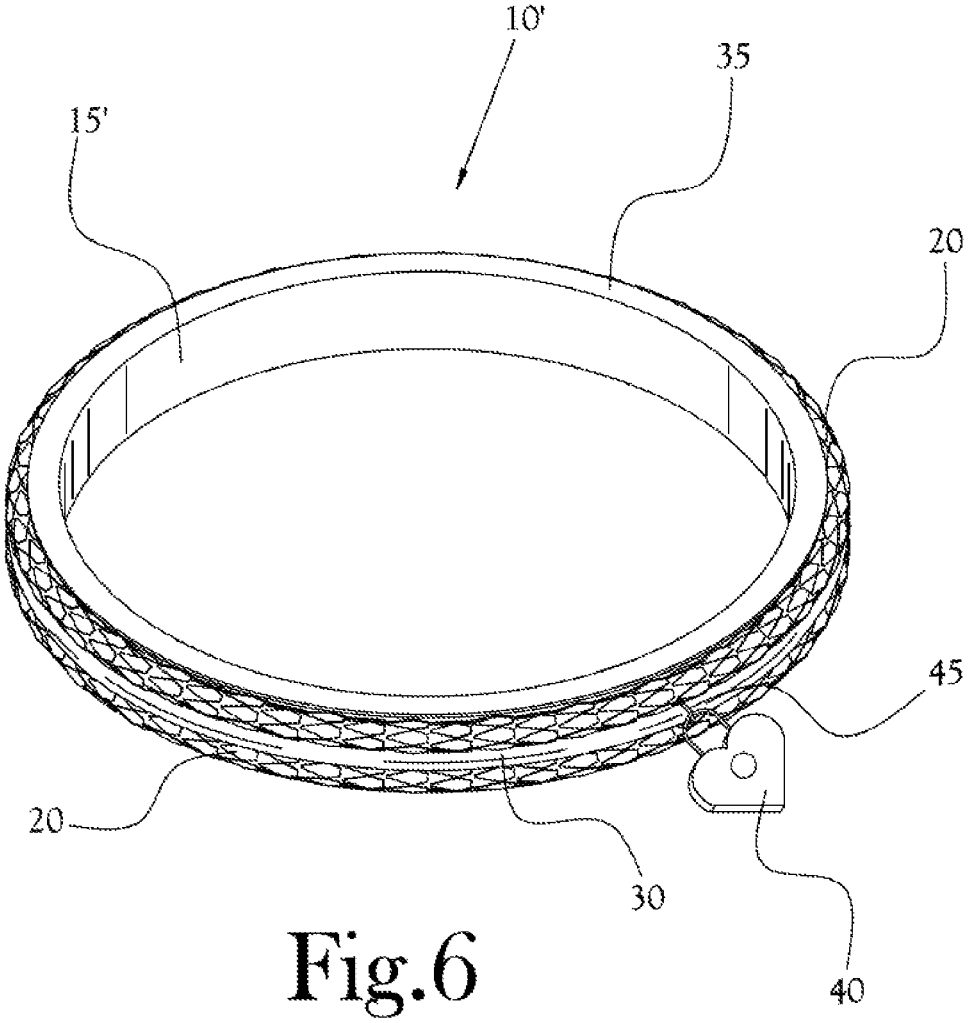
FIG. 6 is a perspective view of yet another alternate embodiment of the multi-functional bracelet of the present invention.

FIGS. 1-3B show a bangle style, substantially circular, multifunctional bracelet 10. In an alternate embodiment, illustrated in FIG. 4, the multi-functional bracelet 210 has a substantially elliptical shape or can have a substantially ovoid shape. Further, as opposed to the solid ring of the bangle style illustrated in FIGS. 1-3, this embodiment of the multi-functional bracelet 210 is opened or closed with a clasp member (not shown). In one embodiment the halves 255 of the multi-functional bracelet 210 rotate around a pin-set 265 defining a pivot point. Those skilled in the art will recognize that there are numerous clasp members in the jewelry art that would allow multi-functional bracelet 210 to be opened and closed.

In an alternate embodiment of the present invention, illustrated in FIGS. 6, 7A, 7B, 7C and 8, a multi-function bracelet 10' is provided that includes a cylindrical base member 15' having two outwardly extending edge members 35. Further, at least one outwardly extending annular wall member 70 is disposed on the base member 15' between the two edge members 35 so as to provide for at least two channels defined on the base member. In the embodiment illustrated in FIGS. 6, 7A, and 7B, one annular wall member 70 is provided such that each channel is bounded by the base member 15', an edge member 35 and the annular wall member 70. At least two of elastic jewelry strand members 20 are provided and are carried by the base member 15' between the two edge members 35 such that each jewelry strand member 20 is disposed within each channel bounded by the cylindrical base member 15', an edge member 35 and the annular wall member 70. In an exemplary embodiment, the two edge members 35, and the annular wall member 70 project outwardly from and are in a substantially orthogonal relationship to the cylindrical base member 15'. In the embodiment of the multi-functional bracelet 10" illustrated in FIG. 7C, two annular wall members 70 are provided such that three channel are formed, the outer two of which are bounded by the base member 15', an edge member 20 and an annular wall member 70. The middle channel is bounded by the base member 15" and two annular wall members 70. Three elastic jewelry strand members 20 are provided and are carried by the base member 15" between the two edge members 35 such that each jewelry strand member 20 is disposed within each channel and two elastic ring members are received by the multi-functional bracelet 10" as described hereinbelow.

Figure 7A:
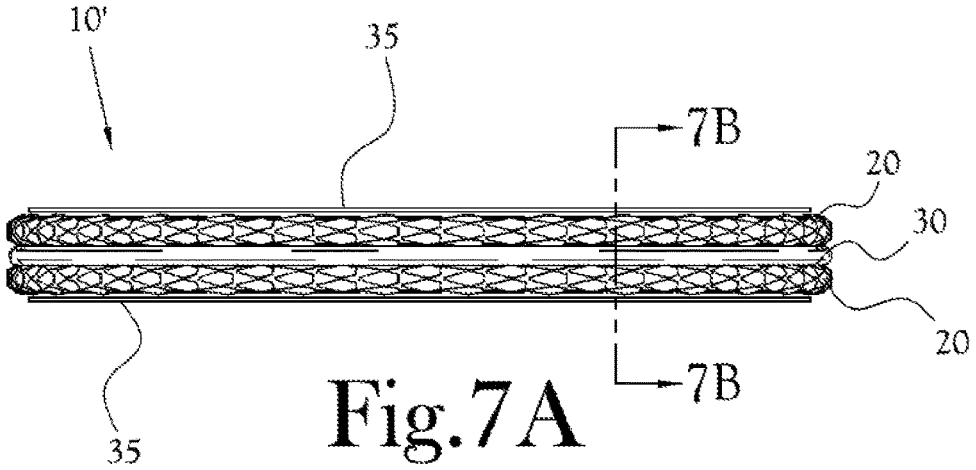
FIG. 7A is a side elevation view of the embodiment of the multi-functional bracelet illustrated in FIG. 6.
Figure 7B:
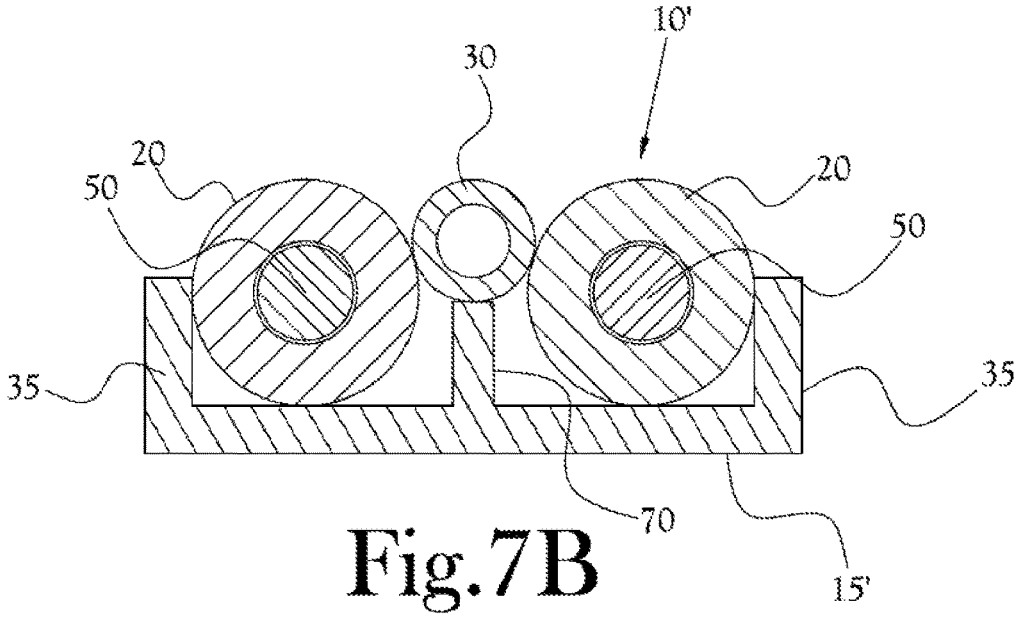
FIG. 7B is a cross-sectional view taken at cut-line 7B in FIG. 7A.
Figure 7C:
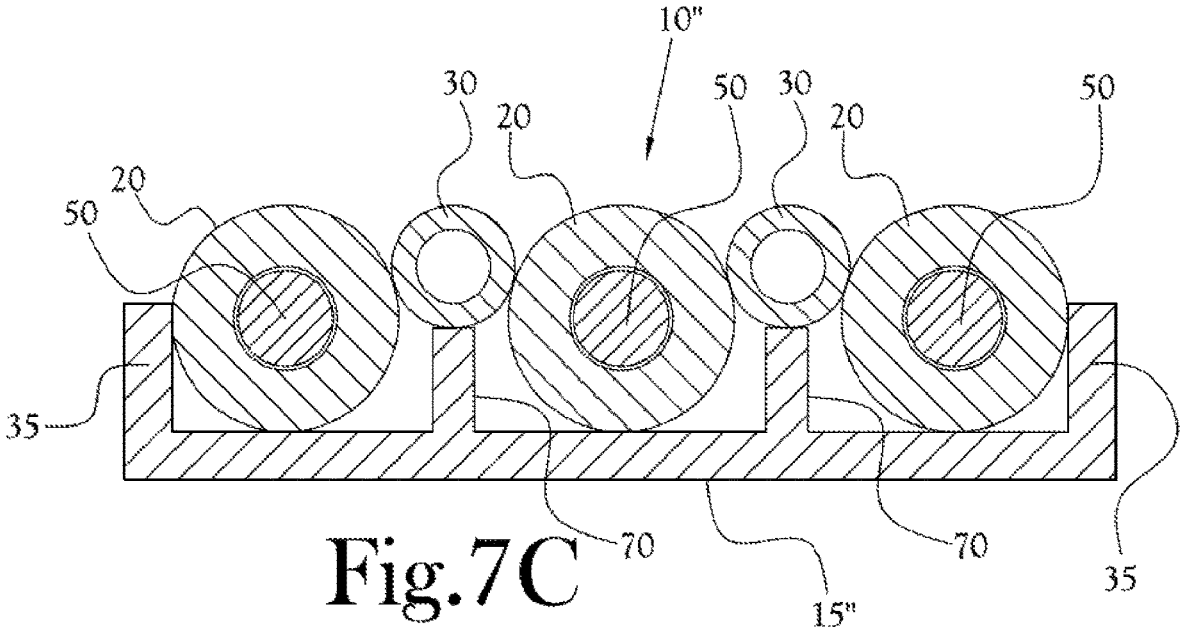
FIG. 7C is a cross-sectional view, of a further exemplary embodiment of the multi-functional bracelet shown in FIG. 7B.
Figure 8:
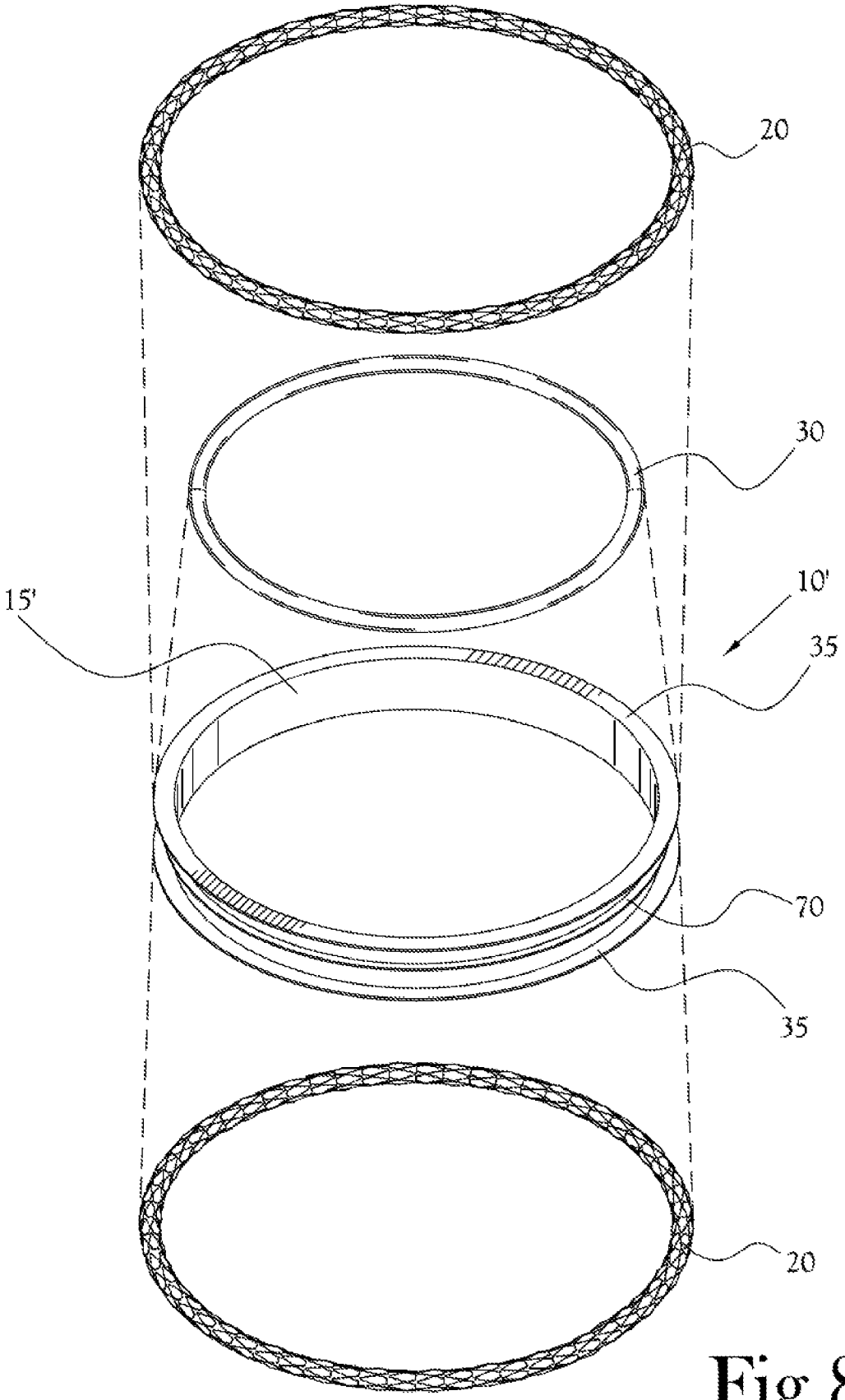
FIG. 8 is an exploded view of the embodiment of the multi-functional bracelet illustrated in FIG. 6.

As described above, the cylindrical base member 15" is adapted to be received by and worn on the wrist of the user. The multi-function bracelet 10" further includes an elastic ring member 30 adapted to be stretched over the elastic jewelry strand members 20 and tautly received between the elastic jewelry strand members 20 and such that it rests substantially upon annular wall member 70 as illustrated in FIGS. 7B and 7C. In an exemplary embodiment, the height of annular wall member 70 can be selected such that the top of elastic ring member 30 is substantially flush with the tops of elastic jewelry strand members 20. When removed from the bracelet 10' or 10", the elastic ring member 30 can be worn in the hair of the wearer of the multi-functional bracelet 10 as an elastic hair band. Thus, the multi-function bracelet 10' or 10" serves to function as an ornamental piece of jewelry and also as a receptacle and storage device for an elastic hair band, defined by the elastic ring member 30, when the elastic hair band is not being worn in the hair of the wearer of the multi-function bracelet 10' or 10".

From the foregoing description, it will be recognized by those skilled in the art that a multi-functional piece of jewelry, namely a multi-functional bracelet that is adapted to receive an elastic hair band in an aesthetically pleasing manner when such elastic hair band is not being worn in the hair of the wearer has been provided.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A multi-functional bracelet adapted to receive a hair accessory, said multi-functional bracelet comprising:

a cylindrical base member adapted to be received by and worn on a user's wrist;

a pair of outwardly extending edge members disposed on and projecting from said cylindrical base member in a substantially orthogonal relationship to said cylindrical base member;

at least a first and a second jewelry strand member carried by said cylindrical base member between said edge members and in spaced relation from one another, said edge members being adapted to retain said jewelry strand members on said cylindrical base member; and at least one elastic ring member adapted to be received between said jewelry strand members, whereby said at least one elastic ring member is adapted to be worn in the user's hair as an elastic hair band, said elastic hair band defining said hair accessory.

2. The multi-functional bracelet of claim 1 further including a graspable tab member carried by each of said at least one elastic ring member.

3. The multi-functional bracelet of claim 2 wherein a jump ring is disposed between said graspable tab member and said at least one elastic ring member.

4. The multi-functional bracelet of claim 1 wherein said jewelry strand members comprise three jewelry strand members in spaced relation from one another.

5. The multi-functional bracelet of claim 1 wherein said cylindrical base member and said jewelry strand members are integrally formed.

6. The multi-functional bracelet of claim 1 wherein said jewelry strand members are stretchable and are removably carried by said base member whereby a plurality of said jewelry strand members are interchangeable.

7. The multi-functional bracelet of claim 1 further comprising at least one outwardly extending annular wall member disposed on and projecting from said cylindrical base member between said two edge members so as to provide for a pair of channels defined on said cylindrical base member, such that each channel is bounded by at least said cylindrical base member and one of said edge members, wherein each said jewelry strand member is disposed within each said channel bounded by said cylindrical base member and one of said edge members, wherein said outwardly extending annular wall member is in a substantially orthogonal relationship to said cylindrical base member.

8. A multi-functional bracelet adapted to receive a hair accessory, said multi-functional bracelet comprising:

an elliptical base member adapted to be received by and worn on a user's wrist;

a pair of outwardly extending edge members projecting from said elliptical base member wherein said outwardly extending edge members are in a substantially orthogonal relationship to said elliptical base member;

at least a first and a second elastic jewelry members carried by said elliptical base member between said edge members, said edge members being adapted to retain said jewelry members on said elliptical base member;

at least one outwardly extending annular wall member disposed on said elliptical base member and in a substantially orthogonal relationship to said elliptical base member, wherein said annular wall member is disposed on said elliptical base member between said two edge members so as to provide for a pair of channels defined on said elliptical base member, such that each channel is bounded by at least said elliptical base member and one of said edge members, wherein each said jewelry strand member is disposed within each said channel bounded by said elliptical base member and one of said edge members;

at least one elastic ring member adapted to be received between said elastic jewelry members, whereby said at least one elastic ring member is also adapted to be worn in the user's hair as an elastic hair band, said elastic hair band defining said hair accessory; and a graspable tab member carried by said at least one elastic ring member.

9. The multi-functional bracelet of claim 8 wherein a jump ring is disposed between said graspable tab member and said at least one elastic ring member.

10. The multi-functional bracelet of claim 8 wherein said jewelry strand members are stretchable and are removably carried by said elliptical base member whereby a plurality of said jewelry strand members are interchangeable.

* * * * *